US005337592A

United States Patent [19]

Paulson

[11] Patent Number: 5,337,592

[45] Date of Patent: Aug. 16, 1994

[54] NON-STRETCH BENDING OF SHEET MATERIAL TO FORM CYCLICALLY VARIABLE CROSS-SECTION MEMBERS

[76] Inventor: Wallace S. Paulson, 771 Avocado Ave., Corona del Mar, Calif. 92625

[21] Appl. No.: 933,360

[22] Filed: Aug. 20, 1992

[51] Int. Cl.[5] ..... B21D 13/00; B21D 37/20

[52] U.S. Cl. ..... 72/177; 72/181; 72/196; 29/895; 76/101.1

[58] Field of Search ..... 72/177, 176, 181, 180, 72/196; 29/895; 492/30; 76/101

[56] References Cited

U.S. PATENT DOCUMENTS

| | | | |
|---|---|---|---|
| 317,868 | 5/1885 | Smith . | |
| 899,817 | 9/1908 | Ward . | |
| 1,677,031 | 7/1928 | Kuehn . | |
| 1,704,321 | 3/1929 | Hazen | 72/196 |
| 2,007,284 | 7/1935 | Rafter . | |
| 2,251,967 | 8/1941 | Yoder . | |
| 2,294,324 | 8/1942 | Wilkens et al. . | |
| 2,471,490 | 5/1949 | Mercer . | |
| 2,505,241 | 4/1950 | Gray et al. . | |
| 2,664,177 | 12/1953 | Hammitt et al. . | |
| 2,781,877 | 2/1957 | Ochiltree . | |
| 3,137,922 | 6/1964 | Schumacher . | |
| 3,344,641 | 10/1967 | Pomory . | |
| 3,462,989 | 8/1969 | Fischer, Jr. . | |
| 3,992,162 | 11/1976 | Gewiss . | |
| 4,130,974 | 12/1978 | Chalmers | 72/181 |
| 4,220,423 | 9/1980 | Sivachenko . | |
| 4,343,171 | 8/1982 | Kagawa | 72/177 |
| 4,526,024 | 7/1985 | Toti . | |
| 4,578,978 | 4/1986 | Onodo et al. . | |
| 4,662,734 | 5/1987 | Nishi . | |
| 4,876,837 | 10/1989 | Kelly et al. . | |

FOREIGN PATENT DOCUMENTS

| | | | |
|---|---|---|---|
| 148419 | 2/1951 | Australia | 72/177 |
| 46822 | 3/1985 | Japan | 72/177 |

*Primary Examiner*—Daniel C. Crane
*Attorney, Agent, or Firm*—James G. O'Neill

[57] ABSTRACT

Machines for producing, processes for producing, and a process for designing tooling to bend longitudinally cyclically variable cross-section members from sheet material are provided. The products are for specific applications, and are produced in machines by processes in which a plurality of sets of rollers with mating non-axisymmetric surfaces are specifically designed and mounted in an accurately spaced serial array for bending sheet material passing therethrough a predetermined amount, concurrently in the longitudinal and transverse directions, depending on the shape of the product to be formed and the ductility, strength and stiffness of the sheet material. Each set of non-axisymmetric rollers is driven at a predetermined speed with the roller sets being rotationally synchronized with each other and the spacing of each set of rollers from its neighboring sets of rollers is further predetermined so that the cyclical characteristics of the product being incrementally formed flows smoothly from each set of rollers to the next. The rotational speed of each set of rollers is determined by the linear speed of the product being formed as it enters each set of rollers and the number of product geometry cycles to be performed by each set of rollers on the product.

20 Claims, 7 Drawing Sheets

FIG. 17
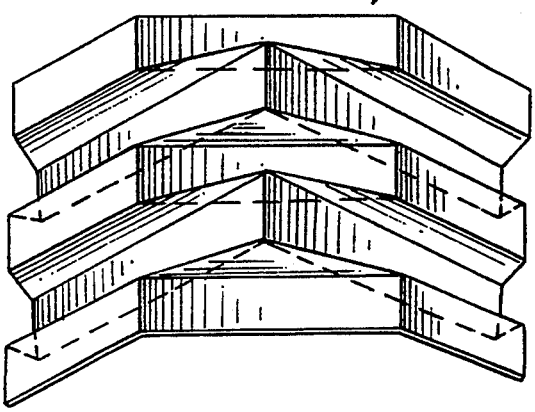
FIG. 18
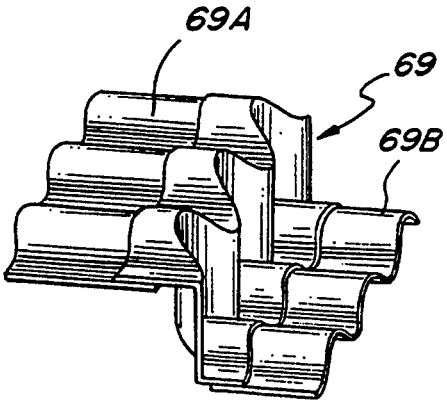
FIG. 19
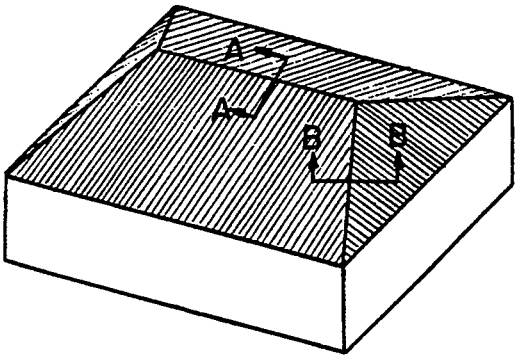
FIG. 20
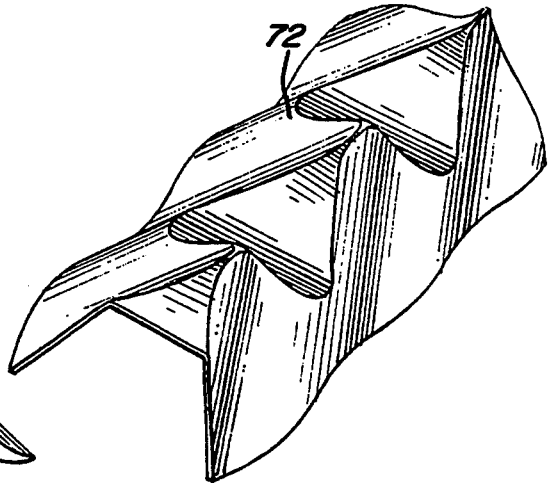
FIG. 21
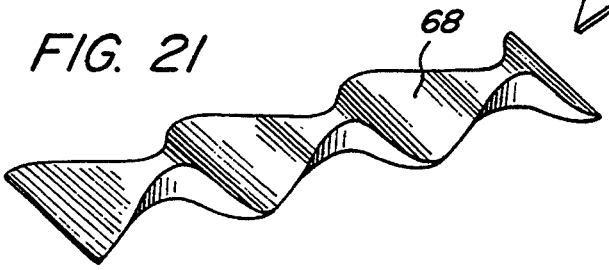
FIG. 22
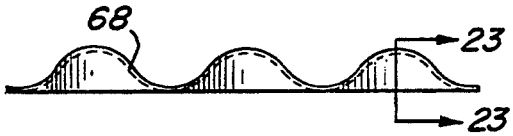
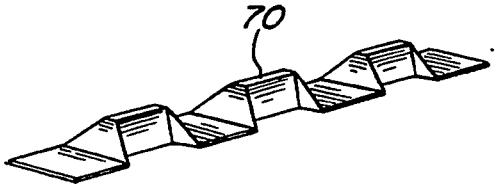
FIG. 24
FIG. 23
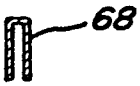

NON-STRETCH BENDING OF SHEET MATERIAL TO FORM CYCLICALLY VARIABLE CROSS-SECTION MEMBERS

BACKGROUND OF THE INVENTION

1. Field of the Invention

This invention relates generally to roll forming of sheet materials to form members and, more particularly, to types of members that may be formed from, a process for, and tooling to perform, the non-stretch bending of sheets of material, simultaneously in a plurality of directions, thus yielding a product that has cyclically variable cross-sections.

2. Description of Related Art

Many manufacturing processes and machines are known for forming structural and other members to be used in connecting various elements and assembling or constructing various structures. Among these known means are corrugated panels, which enjoy worldwide popularity as a simple, low cost way of providing thin sheet stock material with greatly increased stiffness. Consequently, corrugated structures enjoy world-wide popularity for a wide variety of applications.

Corrugated panels are commonly supported by a network of support beams, which typically are elongated, constant crosssection members. The designer is faced with certain interface difficulties where adjoining non-planar corrugated panels meet, and where corrugated panels meet their linear support beams. These difficulties include:

Joining non-planar corrugated panels presents both load transfer and environmental closure problems.

Gaps between a corrugated panel and its support beam, occurring at each cycle of the corrugation pattern, often need closure to block against foreign matter entry.

Load transfer between a corrugated panel and its support beam often places constraints on panel design where the transverse shear stress must be redistributed to transfer its shear load to the beam at the corrugation apex points in contact with it.

Solutions to these problems are known. Block cross-section filler material is used to fill voids. Constant cross-section edge members have been designed to provide an acceptable interface structure between non-planar panels and between corrugated panels and their linear support elements.

A widely used means of making long, constant cross-section edge members is roll forming. The roll forming process uses the simple technique of bending sheet stock without the need for in-plane straining or stretching used for more complex, costly processes, such as stretch forming or pressing. Thus, the roll forming process requires minimal forming forces and material ductility, and enjoys wide use in fabricating many low cost linear products.

The known means for roll forming shaped members generally uses a plurality of serially positioned axisymmetric roller sets to form a predetermined constant cross-section linear member from a supply of continuous flat metal sheet stock fed into the machine. Drives and guides provide means to ensure the proper course of the material through the machine. Each roller set consists of at least two mated rollers, which are axisymmetrical, body-of-revolution rollers, designed to work in concert to incrementally bend the entering sheet stock material toward the finally desired shape. Each forming step in the machine is limited to the degree permitted by the supply material constraints of strength, stiffness and ductility.

Over the past several decades, roll forming tools have been highly developed to provide many sophisticated adaptations to improve formability, forming speeds and shape complexities. However, these known roll forming tools and machines are still characterized and limited by the fundamental properties of serially positioned, axisymmetric roller sets, acting upon a supply of flat sheet stock, to form a desired constant cross-section product by bending.

Many other classes of machines and processes are also known for forming complex shaped products, but these machines and processes form such products by stretch and/or shear forming the materials used, requiring much greater forming forces and material ductility, resulting in higher costs compared to those formed by simple bending processes.

The following listed U.S. Patents disclose various members formed by, or methods and apparatus for roll or stretch forming sheets of material into various shaped members: U.S. Pat. Nos. 317,868, 899,817, 1,677,031, 2,007,284, 2,251,967, 2,294,324, 2,471,490, 2,505,241, 2,664,177, 2,781,877, 3,137,922, 3,344,641, 3,462,989, 3,992,162, 4,220,423, 4,526,024, 4,578,978, 4,662,734 and 4,876,837. However, the specific disclosures of these patents fail to show or utilize apparatus, and/or processes to design tooling, or to form complex members by the non-stretch bending of sheet materials, in a plurality of directions, using serial sets of nonaxisymmetrical rollers, as disclosed and claimed by applicant herein. Applicant's present invention is applicable throughout the world, and should increase the use and decrease the cost of corrugated constructions for varied uses and applications.

SUMMARY OF THE INVENTION

Accordingly, it is a general object of the present invention to provide a machine for the non-stretch bending of sheet material in both the longitudinal and lateral directions to form cyclically variable cross-section members. It is a more particular object of the present invention to provide a machine for non-stretch bending of cyclically variable cross-section members, using serial non-axisymmetrical roller sets. It is yet another object of the present invention to provide a process for forming cyclically variable cross-section members. It is still a further object of the present invention to provide a process for designing selected tooling for use in the machine and process of the present invention. And it is yet a still further object of the present invention to provide families of cyclically variable cross-section members, for specific uses, formed by the machines and processes disclosed herein.

In accordance with the present invention there is provided a process for forming tooling comprised of a series of sets of non-axisymmetrical rollers for the incremental non-stretch bending of cyclically variable cross-section members. The roller sets are selectively designed to form a specifically shaped cross-sectional member for a defined purpose, using the process of the invention, including making a flat pattern layout of the unique bend line pattern for sheet bends needed for a desired final end product. The present invention also includes a novel and simple process for forming specifically designed end products by the non-stretch bending of sheet materials by passing sheet material through a plurality of specifically designed non-axisymmetrical roller sets, spaced a predetermined distance apart, and driven at predetermined speeds. And the present invention encompasses families of products produced by the machines and processes of the invention.

As an example of the families or types of products that can be formed by the novel processes and tooling designed in accordance with the processes of the present invention, there are disclosed a number of corrugated cap or closure edge members for use with various corrugated panels to join and/or cover exposed ends or close gaps where such panels meet neighboring panels or support frames. It should be obvious to those skilled in the art that such members have wide applications, and may be produced and assembled to provide substantial benefits over known methods of production and assembly.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

FIG. 17 shows a symmetrical cap member, similar to FIG. 4, but for a trapezoidal corrugation;

FIG. 18 shows a Zee section member, formed by the methods of the present invention, being used to connect two non-planar corrugated panels;

FIG. 19 shows a corrugated hip roof having a ridge region (Section A—A) and a hip joint region (Section B—B), to illustrate where normal and bias versions of the constructed members of the present invention can be utilized;

FIG. 20 shows a perspective view of a bias corrugated cap for use at the hip joint of Section B—B of FIG. 19;

FIGS. 21 through 23 show perspective, side and end views of a closure element for curved corrugated panels;

FIG. 24 shows a perspective view of a closure element for trapezoidal panels.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for a process to fabricate tooling to form members, as well as products formed by the processes, and an improved machine and process for forming cyclically variable members, such as, but not limited to, corrugated cap or closure edge members, for use with corrugated sheet materials.

Figure 1:
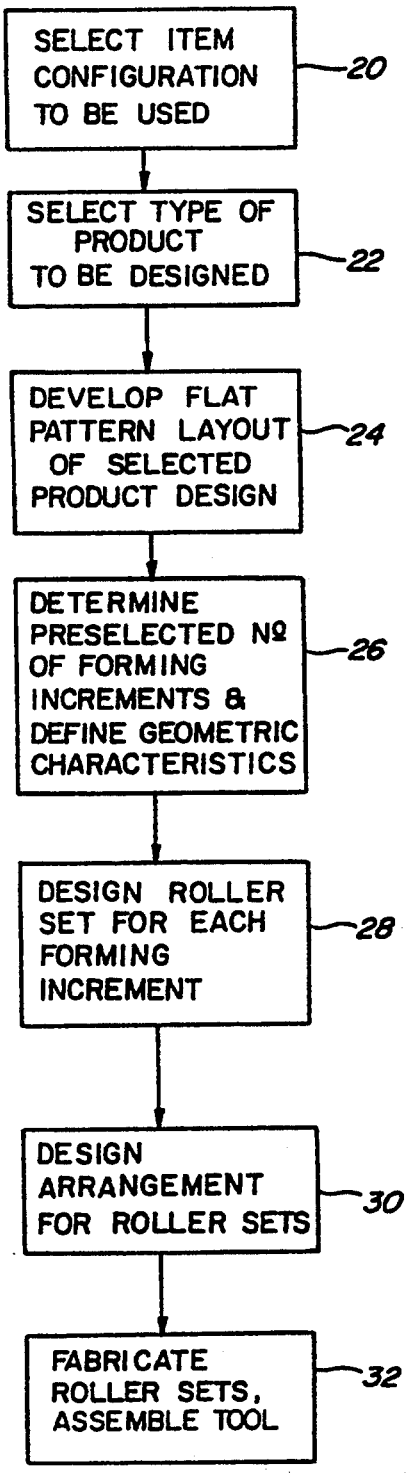
FIG. 1 is a block diagram illustrating the sequential steps of designing roller sets to be used to form cyclically variable cross-section members in accordance with the present invention.

FIG. 1 illustrates, in a block diagram, the sequence of events or steps performed to design tooling, or sets of rollers, for use in a machine and process to make cyclically variable cross-section members in accordance with the present invention. This sequence of steps provides a preferred process to form tooling which will simultaneously form, by bending only, longitudinal and transverse bends on a continuous member.

Figure 2:
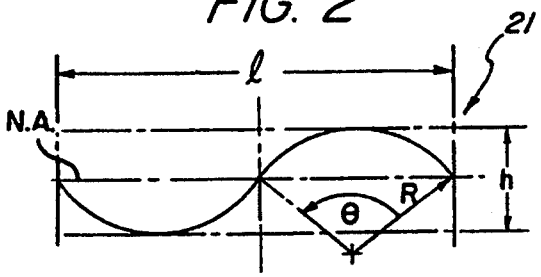
FIGS. 2–6 show an example of a cap member, and various design phases in an example of the steps to be used in designing tooling therefor, in accordance with the steps of FIG. 1.

As shown in a first box 20, a selection must be made of a specific item configuration, such as a corrugated panel configuration, to be used with a further item to be designed, such as a corrugated edge member. For example, for purposes of illustration only, and not by way of limitation, FIG. 2 shows a sine-wave shaped corrugation 21 selected for such panel configuration. For purposes of this example and explanation, the corrugation of FIG. 2 has a depth or height h of 0.625 inches, a cycle pitch 1 of 2.50 inches and a curvature radius R of 25/32 of an inch. Therefore, angle $\theta$ thereof equals 106° 16′and Arc length $=R\theta$, or 1.449 inches. Arc length equals one half of true length (T.L.) of each cycle, so that T.L. for this corrugation is 2.898 inches. The shortening factor Ks for this corrugation is (pitch)/(true length), or $Ks=2.50/2.898=0.8627$. This shortening factor represents the longitudinal foreshortening characteristic of the fully formed edge member, calculated by comparing the longitudinal dimension per cycle of the finished product to its flat pattern equivalent on the entering flat sheet stock.

As illustrated in a second box 22, after the corrugated panel configuration of box 20 is selected, a type of product to be designed for use therewith, such as an edge member, is selected. For use with the example of the corrugated panel described above, FIG. 3 shows a symmetrical 30° roof cap member 23 that has been selected to be designed. The geometry of FIG. 3 has been developed by known means to represent the unique set of geometry that will create an edge member that can be formed from flat sheet stock by bending-only ("non-stretch bending") that will meet the given requirements of panel cross-section and joint geometries. This corrugated cap member 23 has the following dimensions: d=2.332 inches; h=0.625 inches; H=1.500 inches; and e=0.688 inches. A perspective view of this edge member is shown in FIG. 4.

Figure 5:
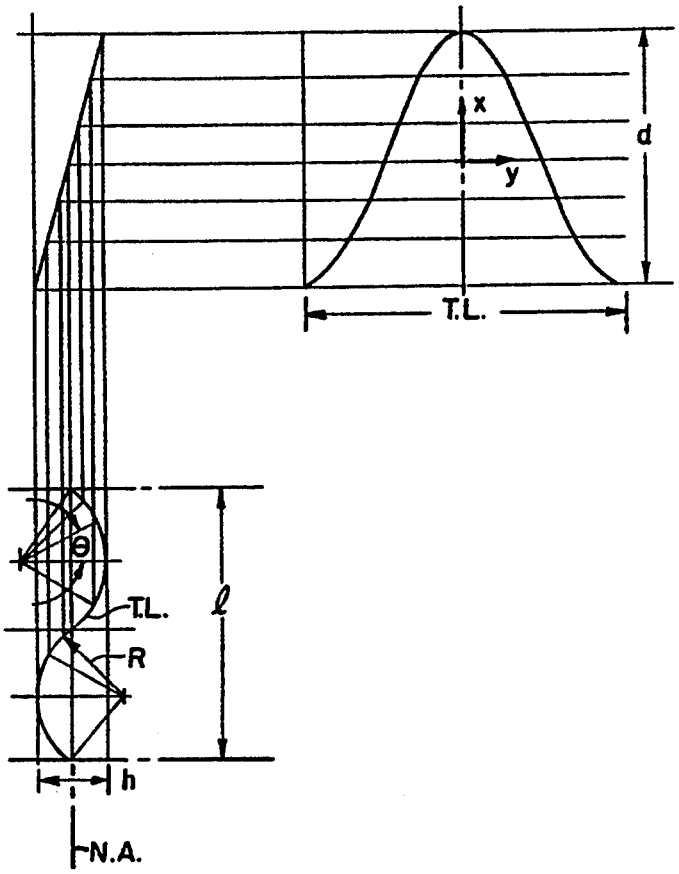
Figure 6:
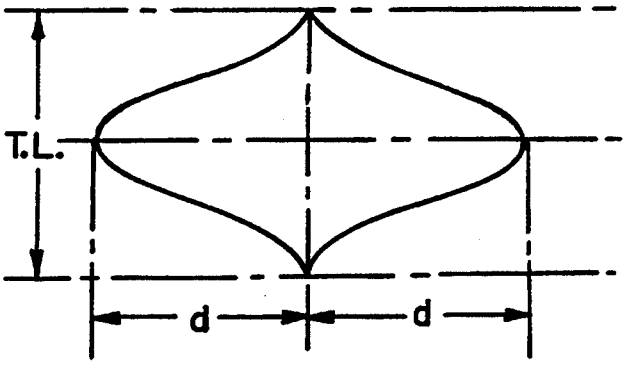

A third box 24 shows that a flat pattern layout of a bend line pattern of sheet bends needed for the selected product to be formed must then be developed. In the example herein used, FIG. 5 illustrates how a flat pattern layout of the selected edge member 23 is developed using known descriptive geometry and drafting techniques; while FIG. 6 illustrates the specific flat pattern. Furthermore, table A, set forth below, shows how the points along the development of the developed flat pattern curve are actually calculated:

TABLE A

| Θ | cos Θ | x | y |
|---|---|---|---|
| 0 | 1.000 | 1.166 | 0 |
| ±10° | .98410 | 1.122 | ±.13635 |
| ±20° | .93969 | .9904 | ±.2727 |
| ±30° | .86603 | .7756 | ±.4090 |
| ±45° | .70711 | .3123 | ±.6136 |
| ±50° | .64279 | .1248 | ±.6818 |
| ±53.15° | .59970 | 0 | ±.7240 |

A fourth box 26, shows that a selection of a predetermined number of forming increments to be used in developing the final shape of the product to be formed must now be made. The properties of the material to be formed and the magnitude of the material bending required to take place are factors to be considered when making this selection of the number of incremental forming stages. Preferably, each forming increment (roller set, or forming station) should be designed to maximize the amount of incremental bending to occur (and thus to minimize the number of roller sets or forming stations needed), within the constraints of material deformation limits achievable in each forming stage. Once the number of forming increments have been selected, the geometry characteristics of the developing edge member must be defined at each forming stage as it comes off each of the serial tooling sets. In the example referred to herein, three roller sets have been selected and the geometry of the incrementally formed product stages are defined in Table B, below, where A is the first station, B the second station and C the third, or final station. It should be noted that small geometry modifications may normally need to be made, particularly to the last stage roller geometries, to compensate for the "spring-back" characteristics of the specific material being formed, while achieving the desired final configuration of the product.

TABLE B*

| Forming | Flat | A | B | C-Final |
|---|---|---|---|---|
| R | ∝ | 2 | 1 | 25/32 |
| Θ | 0 | 41° 31′ | 83° 2′ | 106° 16′ |
| l | 2.898 | 2.834 | 2.6514 | 2.50 |
| h | 0 | 0.26 | 0.5025 | 0.625 |
| Φ | 0 | 12° 48′ | 24° 19′ | 30° |
| d-const | 2.332 | 2.332 | 2.332 | 2.332 |
| width (w) | 6.00 | 5.967 | 5.882 | 5.821 |
| e-const | 0.688 | 0.688 | 0.688 | 0.688 |
| H | 0 | 0.66465 | 1.23534 | 1.500 |

Figure 3:
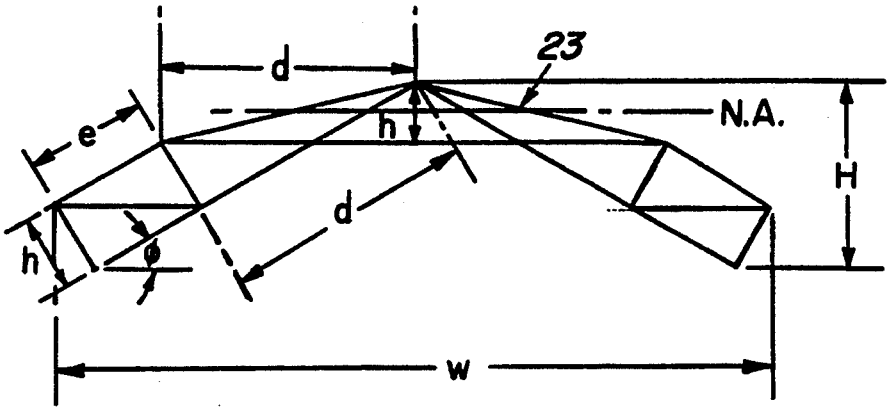
Figure 4:
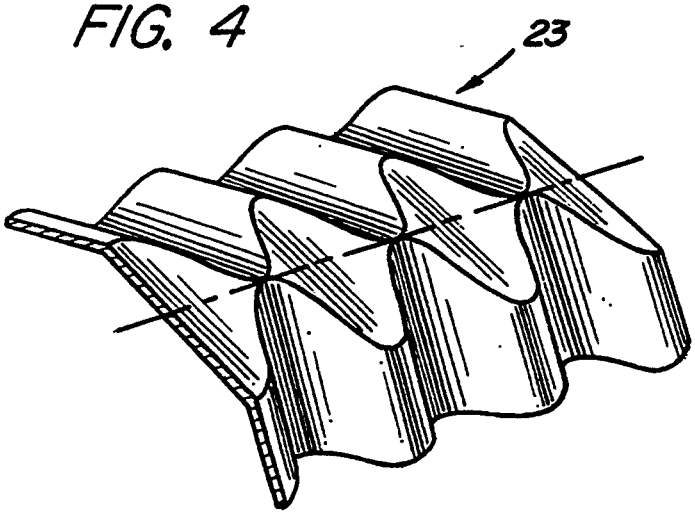

*See FIGS. 2 and 3 for dimensions

A fifth box 28 illustrates that the tool roller set for each forming stage or station selected in box 26 must now be designed. This is accomplished by first determining the number of forming cycles needed for the roller tool set being designed. Generally, the fewest number of cycles per forming roller set will be preferred, to thereby minimize tool size. However, roller set design practicalities will usually require more than one cycle, taking into consideration the geometry of the product to be formed and a requirement that each roller must have a central shaft region to provide for sufficient tool integrity and rigidity, as well as a means for mounting each roller on a shaft for rotation. An early step in roller design is to establish a reference "neutral axis" for the edge member cross section. The neutral axis (N. A.) location should normally be positioned at the location of the "neutral axis" of the primary bend cross section of the final product, as shown in FIGS. 2 and 3 for the example case under discussion. Table C, set forth below, provides the designs of the three roller sets for the example discussed above.

TABLE C*

| Forming Stage Parameters | Flat | A | B | C-Final |
|---|---|---|---|---|
| Tool cycles | 4 | 4 | 4 | 5 |
| D(Tool) N.A. | 3.68985 | 3.60887 | 3.37587 | 3.978 |
| Dmax. | " | 3.869 | 3.878 | 4.603 |
| Dmin. | " | 3.349 | 2.873 | 3.353 |
| Dminor | 3.68985 | 2.540 | 1.407 | 1.603 |

Figure 10:
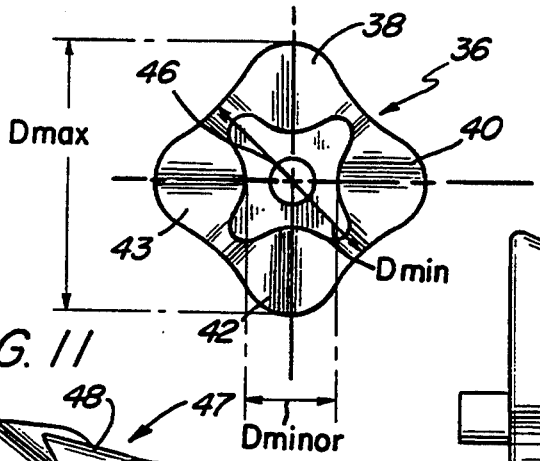

*See FIG. 10 for dimensions; except for D(Tool) N.A., which equals (Dmax. + Dmin.)/2

A sixth box 30 shows that the geometric arrangement for the roller set stations must then be designed. This includes:

- relative rotational speeds for each roller set forming station, to account for the number of product cycles per forming tool set;
- the rotational phasing of each roller station with respect to its neighboring roller sets, to synchronize the cyclical nature of the corrugation's incremental formation at each station; and
- the spacing between each forming station roller set, to account for the appropriate foreshortening parameter, Ks, at each forming station.

Table D, set forth below, lists the roller set parameters for the example referred to above.

TABLE D

| Forming Stage Parameters | Flat | A | B | C-Final |
|---|---|---|---|---|
| Shortening Factor = pitch/true length | 1.000 | 0.9779 | 0.9149 | 0.8627 |
| Roller Tool Speed | Initial feed ref = 1 rev/sec | 1 rev/sec | 1 rev/sec | .8 rev/sec |
| Roller set spacing | — | — | *k(2.834) | *k(2.6514) |

*k = any whole number constant

A seventh box 32 indicates that fabrication of development tooling (roller sets) must now be carried out to verify the design parameters of the incremental tooling sets that were selected in box 26 above. At this point, it may be necessary to modify the selected tooling increments and iterate the design and fabrication steps of boxes 28, 30 and 32, to further optimize the sequence of forming the selected product for production.

Figure 7:
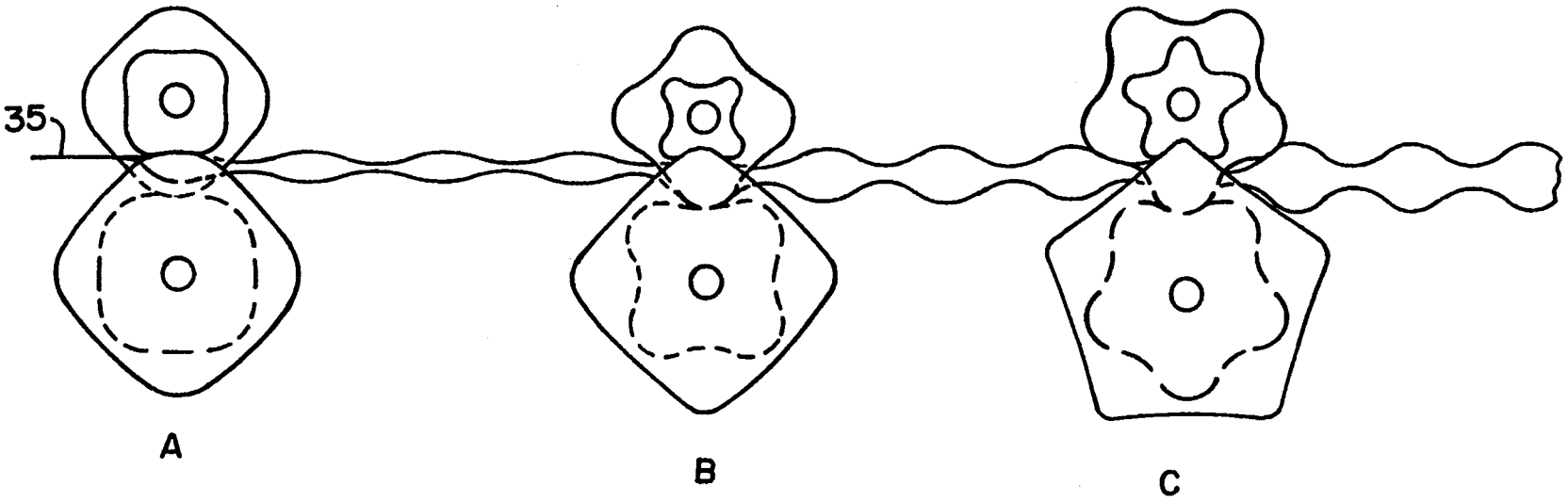
FIG. 7 is a schematic view of a machine having three roller sets or forming stations, designed in accordance with an example of the steps set forth in FIG. 1.

Turning now to FIG. 7, there shown is a machine 34 having three sets of different size rollers A, B, and C spaced therealong, predetermined distances apart, and with the roller sets having specifically determined orientations so that their respective rotations are clocked or synchronized, to form a product from sheet material 35, in accordance with the present invention. The separate roller sets may be driven by one, or a number of drive means, well known to those skilled in the art, once the spacing of the roller sets and the speed of the roller sets to be used to make a specified product are known.

Figure 8:
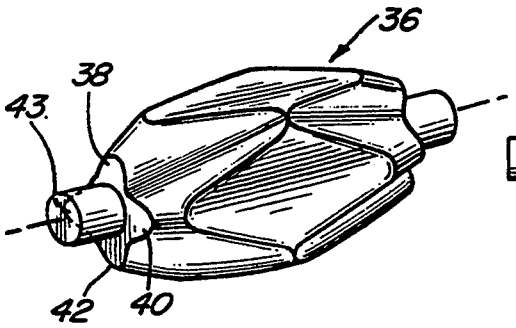
FIGS. 8–10 show a perspective view, as well as side and end views of one of the typical non-axisymmetrical roller used in one of the sets of rollers of FIG. 7.
Figure 9:
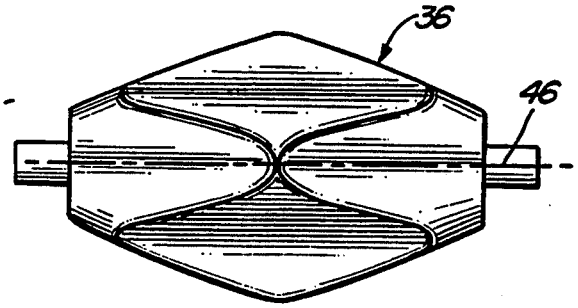
Figure 11:
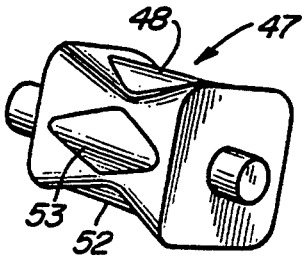
FIGS. 11–13 are views, similar to those of FIGS. 8–10, of the other of the typical non-axisymmetrical roller for mating with the roller of FIGS. 8–10, to form a roller set.
Figure 12:
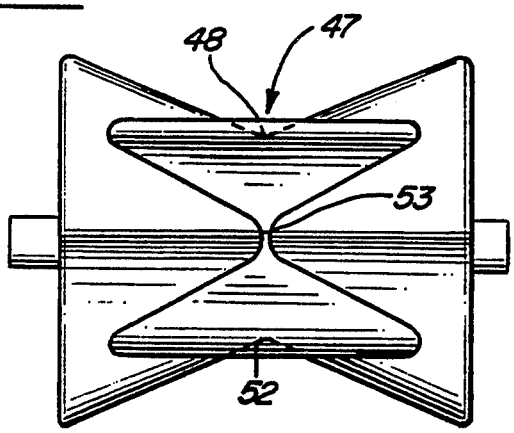
Figure 13:
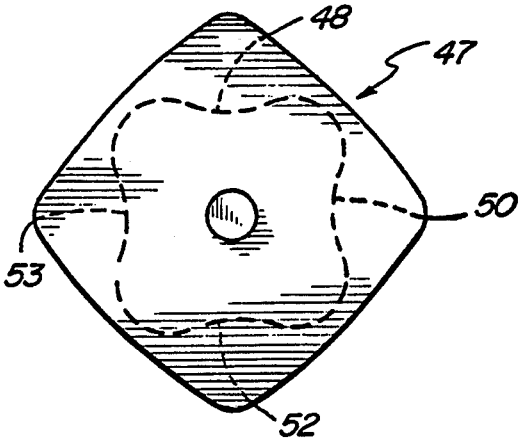

FIGS. 8–13 show an example of a configuration of a pair of mating rollers 36, 47, comprising a roller set, forming stage, or forming station, to make a product in accordance with the example discussed above. Roller 36, as shown in FIGS. 8–10, includes four cycles or lobes 38, 40, 42, and 43 thereon, which cycles vary in size along the axis 46 of the tool so as to conform to the magnitude of predetermined bending designed for that forming roller, as shown in Table B. Roller 36 fits into reverse image cycles or depressions 48, 50, 52, and 53 formed on roller 47, as shown in FIGS. 11–13, and these rollers are paired together in a forming stage or station. As can be readily seen, these rollers are non-axisymmetrical, with the lobes of each cycle extending along the axis thereof at a different distance therefrom, so as to incrementally bend its receiving material product concurrently in both longitudinal and transverse directions. Furthermore, each roller set at a different forming station must be of a different size and must vary in shape, to meet the criteria established therefor, in accordance with the steps set forth above.

The curved or sinusoidal corrugation of FIG. 2 was used in the reference example of a roof peak cap member just discussed. Other embodiments of this technique can be similarly defined. A corrugated edge member can be formed to match the corrugation of any corrugated panel design using the process described. Examples of families or types of low cost edge members that may be produced by the machines and processes of this invention, and how such members may be used, for example, with different types of corrugated panels, are as follows:

Cap members

Figure 14:
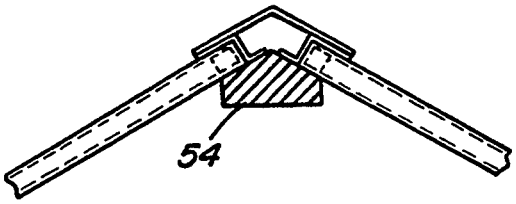
FIG. 14 PRIOR ART
FIGS. 14 and 14A show prior art methods for providing cap members and environmental closure for a corrugated roof peak region.
Figure 15:
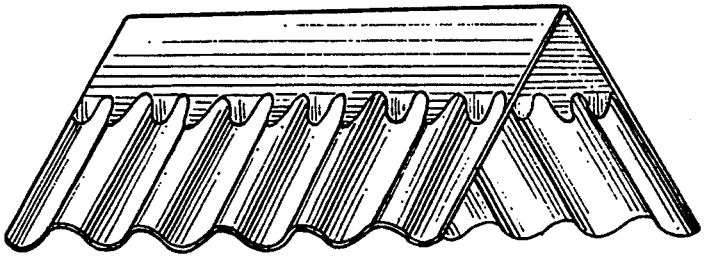
FIG. 15 PRIOR ART
FIG. 15 shows a prior art stretch-formed cap member placed at the peak of a corrugated roof.

The problems of load transfer and environmental closure when joining two or more adjacent corrugated panels that are not coplanar, but which instead meet at an angle, are well known. Examples of such angled meetings occur at the peak of a corrugated roof, or the more complex meeting at a hip joint of a hip roof, of a building, such as shown in FIG. 19. Other examples abound. The typical solution to closing such joints comprises a constant cross-section angle member resting on the peaks of two non-planar corrugated panels having a ridge support 54, with, in some cases, a constant cross-section closure member, formed by known means, supporting this cap angle, as shown in FIG. 14. Another currently known means of closing such angled meetings of non co-planar corrugated panels is by the use of cap members which have been deformed by locally stretching a portion of the element to match the contour of the corrugations to be closed, as shown in FIG. 15. However, such closure members are formed using known stretching techniques, requiring large forming forces and greater material ductility.

The problems discussed above can be more economically and simply solved by using structural cap members formed in accordance with the non-stretch bending machines and processes disclosed herein. Cyclically variable edge member caps for joints or connections between panels may consist of any of several cross-sections, including angles, channels, zees, or combinations thereof. These cap members would add both strength and proper environmental closure to such non-planar joints, in a cheaper and more reliable manner. Also, with their characteristics of not having extended linear elements, they are more resistant to thermal stresses than their current linear counterparts.

Figure 16:
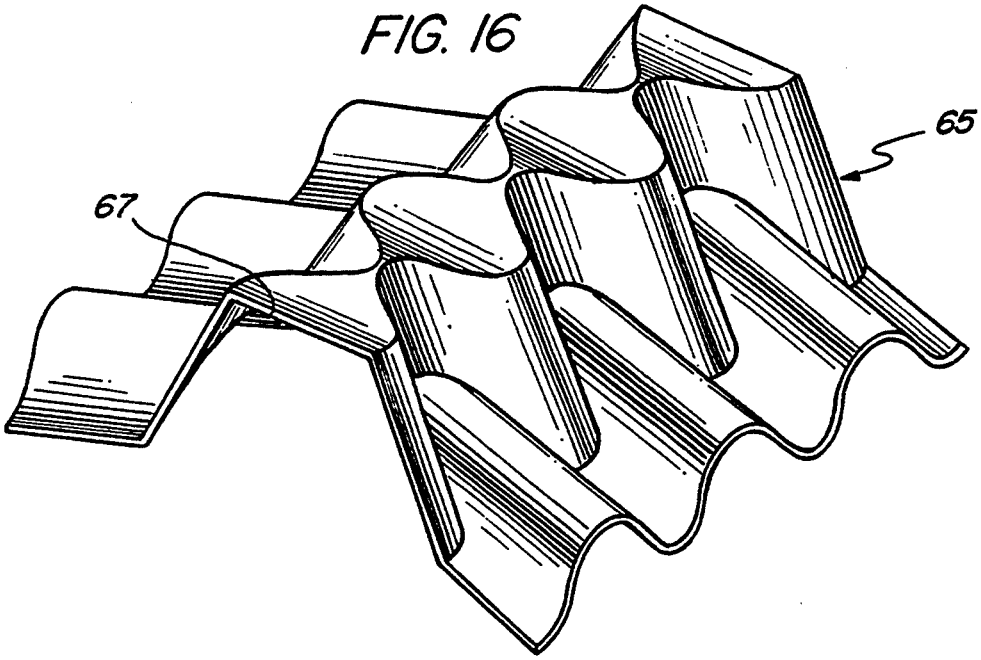
FIG. 16 shows a modified apex cap member for a corrugated roof, where the peak section is raised to clear the region at the apex point of the roof, formed by the methods of the present invention.

It should be noted that the simple solution shown by FIGS. 3 and 4 requires the removal of the apex portion of the roof enclosure, to allow for adequate clearances. However, if this is deemed non-workable in a specific design, a modification, using an offset raised section at the peak, may be designed to permit the connected panels to extend completely to the apex of the intersecting panels. Such a modified cap member is shown at 65 in FIG. 16. This cap member includes an offset raised section 67, substantially centrally thereof.

FIG. 17 shows a still further trapezoidal corrugated cap member 64 to join and cover abutting non-planar trapezoidal corrugated panels on a peaked roof, in a manner similar to that described above.

Any channel-shaped member can become a Zee-section member, merely by reversing the bend direction on one side of the edge member tooling. One application of this type joint is the case where two panels have a small offset at the adjacent edges of the panels. A basic Zee cross-section 69 can become the joining element between two panels 69A and 69B, as shown in FIG. 18, thereby providing both load continuity and environmental closure.

The above disclosed and discussed splicing examples are representative of panels that have their cut edges perpendicular (normal) to the directions of the corrugations. A variant set of edge members is created when the edges of the panels are cut along a bias direction with respect to the direction of the corrugations. The edge member configurations themselves become biased versions of their above described normal counterparts, where the edge members match exactly along the bias edge of the adjoining panels. These bias edge members can most easily be envisioned at the hip joint junctures of corrugated roof panels, as shown at Section B—B in FIG. 19. FIG. 20 shows a corrugated cap 72 to cover such abutting corrugated panels. Again, the offset option as previously described and shown in FIG. 16, may be applied if the joining angle apex cannot be trimmed off. All regular or "normal" configurations can have similar "biased" configurations developed, by bending only, in a similar manner, using the present invention.

Closure members

Corrugated panels are normally supported by a network of support beams. Each panel collects, distributes and transfers both normal and in-plane forces from its load environment to its structural supports. Panel axial, bending and transverse shear forces are carried primarily along the directions of the corrugations formed in the panel, the path of the greatest stiffness, while in-plane shear forces are transferred along all boundaries. A designer has two unique problems to solve when designing structures with corrugated panels: load transfer and environmental closure. Both problems exist at the ends of corrugated panels along the direction of the corrugations, where the panels interface with a support member. For example, if the panel has sinusoidal corrugations meeting a support member, in a well known manner, only the extreme points of the corrugation "valleys" will actually be in contact with the support member. These contact points are where physical attachment could be made to the support beam, in a known way. However, such connections suffer from the two aforementioned problems, namely the low strength and stiffness of the joint compared to the basic strength of the corrugation itself, and the lack of complete closure between the corrugated panel and the support member.

Figure 14A:
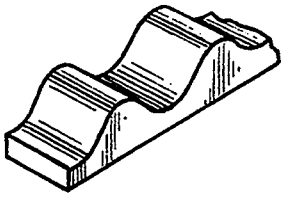
FIG. 14A PRIOR ART

One commonly known means of closing the voids caused when a corrugated panel is supported by a linear support beam is by using a contoured or molded filler strip having a solid block cross-section, made of materials such as wood or elastomers, as shown in FIG. 14A. However, these known means, formed by molding, machining or shearing, are too soft to improve the strength of the joint and/or do not stand up well over time or in their environmental conditions. These problems could be solved by using a structural closure or edge member formed in accordance with the non-stretch bending processes disclosed herein. Closure members formed in accordance with the present invention can add both strength and environmental closure to such joints, in a less expensive and more reliable way, thereby providing further savings. When placed between an adjoining corrugated panel and its support beam, these closure members fill all voids, as well as provide a stiffened, stronger means to support the entire corrugation cross-section, not just the valley contact regions touching the support beam, as is the case with known closure methods. Such a continuous support strengthens one critical constraint in current corrugated structure design - the local shear load transfer from the normal beam-theory shear stress distribution to the usual support load reaction at the corrugation valley contact points with the support beam. This single design constrain change can broaden the range of application for corrugated panels beyond today's design parameters of load, span, cross-section and thickness. Critical design parameters of corrugated panel cross-section depth, shape, gage, span and load can now be redefined using closure members formed in accordance with the present invention.

Figure 25:
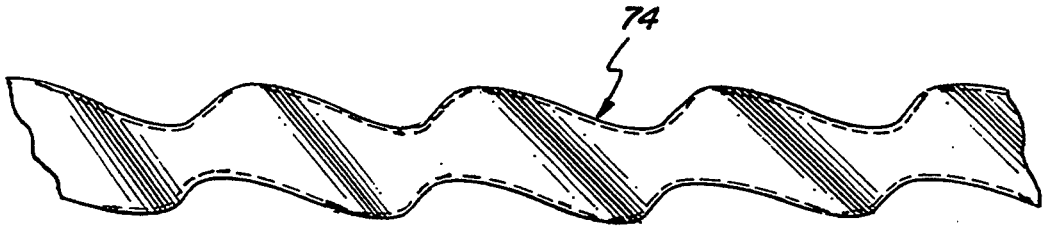
FIGS. 25 and 26 show top and side elevational views of a bias closure element for use with curved corrugated panels along a bias edge, such as exists along the hip joint of a roof, as at Section B—B of FIG. 19.
Figure 26:
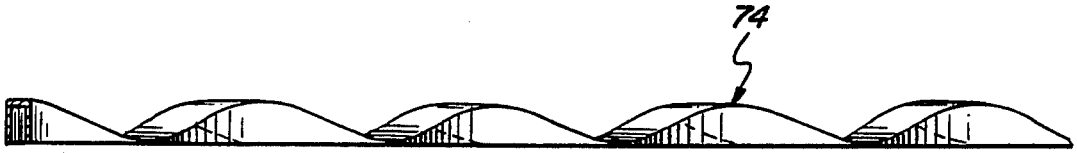

Corrugated edge members, acting as closures for voids as described above, may take any desired shape to match the interfacing corrugated panel, and may be formed from roller set tooling designed and fabricated in accordance with the present invention. FIGS. 21 through 26 show examples of curved and trapezoidal corrugated panel closure members 68, 70 and 74, respectively, to fill the voids and provide support between panels and their support beams. Closure member 68, as shown in FIGS. 21–23, is for use with curved corrugated panels, while closure member 70, as shown in FIG. 24 is for use with trapezoidal corrugated panels. Other closure members can be designed to match any variety of corrugated panel cross-section shapes. Here too, "bias" counterparts of all normal configurations can be formed, for example, 74, as shown in FIGS. 25 and 26, for use along support beams running on the bias to the corrugation direction.

Therefore, it is to be understood that the present invention is not limited to the formation of such end caps and closure edge members as shown herein, but may be applied to the formation of any product for any known or to be discovered application, in accordance with the steps and processes, set forth herein.

Those skilled in the art will appreciate that various adaptations and modifications of the just-described preferred embodiments of the machine, process and tooling design can be reconfigured without departing from the scope and spirit of the invention. Therefore, it is to be understood that, within the scope of the appended claims, the invention may be practiced other than as specifically described herein.

What is claimed is:

1. A forming machine for concurrent longitudinal and transverse, non-stretch sheet bending to form cyclically variable cross section members from flat sheet material, comprising, in combination:

a housing;

a plurality of sets of rollers carried in said housing in a serial array, each of said sets of rollers being dimensioned and shaped so as to have mating non-axisymmetric surfaces to incrementally non-stretch bend said sheet material passing between each of said sets of rollers a predetermined amount, simultaneously in both longitudinal and transverse predetermined directions, depending on the shape of the product to be formed and the ductility, strength and stiffness of the flat sheet material passing between each of said sets of rollers; and driving means for each of said sets of rollers to drive each of said sets of non-axisymmetric rollers at a predetermined, roller configuration-dependent rotational speed, said plurality of roller sets being spaced so that the mating non-axisymmetric surfaces of the downstream roller set engage corresponding zones of the non-stretched and bent sheet material made by the mating non-axisymmetric surfaces of the upstream roller set.

2. The forming machine of claim 1 wherein each roller set of said plurality of sets of non-axisymmetric rollers is driven so as to be rotationally synchronized with each adjacent roller set, and is accurately spaced from each said adjacent roller set a predetermined distance, to coincide with the foreshortening characteristics of the evolving product being longitudinally and transversely non-stretch bent from said flat sheet material.

3. The forming machine of claim 2 wherein the rotational phasing of each roller set must be further synchronized with each adjacent roller set so that the cyclical characteristics of the product being incrementally formed therein flows smoothly from each roller set to the next, thus aligning each specific bend region of the partially formed product exiting one roller set with its corresponding counterpart incremental bend region of the next roller set.

4. The forming machine of claim 3 wherein the rotational speed of each roller set is determined by the linear speed of the evolving flat sheet material non-stretch bent product being formed from the flat sheet material as it enters each roller set and the number of product bend geometry cycles designed into each roller set.

5. The forming machine of claim 4 wherein each roller set is accurately spaced apart from each adjacent roller set a predetermined amount.

6. The forming machine of claim 1 wherein each of said plurality of sets of non-axisymmetric rollers are specifically designed to incrementally form a specifically selected product.

7. The forming machine of claim 1 wherein each of said sets of rollers includes at least one pair of cooperating lobes to incrementally non-stretch bend said flat sheet material passing therethrough.

8. The forming machine of claim 7 wherein each of said sets of rollers includes a plurality of cooperating lobes and the number and shape of cooperating lobes on each set of rollers depends on the cyclical characteristics of the product being incrementally non-stretch bent from the flat sheet material.

9. The forming machine of claim 8 wherein there are at least two sets of rollers.

10. The forming machine of claim 6 wherein the design of said plurality of sets of non-axisymmetric rollers to form said specifically selected product being incrementally non-stretch bent from flat sheet material in said machine, is determined from the predefined bend lines that uniquely describe the sole bend line pattern that is possible for said specifically selected product, and comprises the following steps:

selecting a corrugated panel configuration to be joined with a corresponding corrugated panel configuration;

selecting the specific type of product to be used to join the selected corrugated panel configuration and to be formed in said forming machine;

developing the flat pattern layout of the unique set of bend lines that define the sheet-bend only solution to the specifically selected type of product to be formed in said forming machine;

determining a preselected number of forming increments for said specifically selected type of product and defining geometric characteristics of said specifically selected type of product for sheet-bend-only forming at each of said forming increments in said forming machine;

designing said plurality of sets of rollers to correspond to said preselected number of forming increments;

designing the necessary physical arrangement for each of the designed sets of rollers by selecting the rotational speed for each of said designed rollers sets, defining the rotational phasing of each of said roller sets, and determining the necessary spacing between each roller set in said forming machine;

fabricating said designed sets of rollers for said forming machine; and designing driving means to selectively drive each of said designed sets of rollers at a predetermined, roller configuration-dependent rotational speed in said forming machine.

11. A process for concurrent non-stretch bending of flat sheet material, in longitudinal and transverse directions, to form cyclically variable cross-section products from said flat sheet material, comprising the steps of:

passing said flat sheet material through a plurality of sets of non-axisymmetric rollers mounted in a serial array for simultaneously, incrementally non-stretch bending said flat sheet material passing between each of the sets of rollers a predetermined amount and in both longitudinal and transverse predetermined directions, as determined by the shape of the product to be formed and the ductility, strength and stiffness of the flat sheet material passing between each of said set of rollers; and driving each of said plurality of sets of non-axisymmetric rollers at predetermined speeds, with each of said sets of rollers being rotationally synchronized with its neighboring sets of rollers so that the cyclical characteristics of said product being incrementally non-stretch bent therein flows smoothly from each set of rollers to the next, to align the evolving product non-stretch bend zones so that they engage with their counterpart non-stretch bend zones of the next incremental non-stretch bend roller set.

12. The process of claim 11, further including the step of controlling the rotational speed of each set of rollers in accordance with the linear speed of said product being non-stretch bent from the flat sheet material as it enters each set of rollers and a predetermined number of product geometry cycles designed into each set of rollers.

13. The process of claim 12, further including the step of accurately spacing each set of rollers from its adjacent sets of rollers, a predetermined distance, to coincide with the foreshortening characteristics of said evolving product being formed from said flat sheet material by said incremental non-stretch bend process.

14. The process of claim 11 wherein the design of said plurality of sets of non-axisymmetric rollers to form said product being incrementally non-stretch bent from flat sheet material, is determined from the predefined bend lines that uniquely describe the sole bend line pattern that is possible for said product, and comprises the following steps:

selecting a corrugated panel configuration to be joined with a corresponding corrugated panel configuration;

selecting the type of product to be used to join the selected corrugated panel configuration;

developing the flat pattern layout of the unique set of bend lines that define the sheet-bend only solution to the selected type of product;

determining a preselected number of forming increments for said selected type of product and defining geometric characteristics of said selected type of product for sheet-bend-only forming at each of said forming increments;

designing said plurality of sets of rollers to correspond to said preselected number of forming increments;

designing the necessary physical arrangement for each of the designed sets of rollers by selecting the rotational speed for each of said designed roller sets, defining the rotational phasing of each of said roller sets, and determining the necessary spacing between each roller set;

fabricating said designed sets of rollers; and designing driving means to selectively drive each of said designed sets of rollers at a predetermined, roller configuration-dependent rotational speed.

15. The process of claim 14, further including the step of selecting said number of forming increments to maximize the amount of incremental non-stretch bending occurring at each increment and to minimize the number of sets of rollers needed.

16. The process of claim 15, further including the steps of designing the sets of rollers to include as few as possible forming cycles, given the constraints of said selected type of product to be non-stretch bent, and a requirement that each roller of said sets of rollers must have sufficient integrity and rigidity; and designing a geometric arrangement of said sets of rollers, which includes selecting a relative rotation speed for each set of rollers, selecting a rotational phasing of each set of rollers with respect to its neighboring sets of rollers, and selecting the spacing between each set of rollers.

17. A process for designing tooling for forming cyclically variable cross-section products from sheet material to concurrently non-stretch bend, in longitudinal and transverse directions, said sheet material, comprising the steps of:

selecting a corrugation configuration to be used;

selecting a type of product to be designed for use with said selected corrugation configuration and designing said product with said selected corrugation configuration;

developing a flat pattern layout of the unique set of bend lines that define the sheet-bend-only solution to said selected product design; said flat pattern layout thus establishing geometries of the initial configuration of the sheet material bend lines which, together with the established geometries of the final configuration bend lines of said selected product design, form the initial and final geometries of the selected product design bends, thus enabling intermediate geometries to be calculated for preselected forming increments;

determining a preselected number of forming increments for said selected product design and defining geometric characteristics of said selected product design at each of said forming increments;

designing a set of rollers for each of said forming increments, each set of rollers being non-axisymmetric to concurrently non-stretch bend said selected product design in longitudinal and transverse directions;

designing a geometrical arrangement for each of said designed roller sets; and fabricating said designed roller sets.

18. The process for designing tooling set forth in claim 17 wherein said selected number of forming increments maximizes the amount of incremental bending occurring at each increment and minimizes the number of sets of rollers needed.

19. The process for designing tooling set forth in claim 18 wherein said designed roller sets includes as few as possible forming cycles, given the constraints of said product to be formed and a requirement that said rollers must have sufficient integrity and rigidity.

20. The process for designing tooling set forth in claim 19 wherein said geometric arrangement of said roller sets includes selecting a relative rotation speed for each roller set, selecting a rotational phasing of each of said roller sets with respect to the remaining roller sets and selecting a desired spacing between each roller set.

* * * * *